United States Patent [19]

Ketterman

[11] Patent Number: 5,010,453

[45] Date of Patent: Apr. 23, 1991

[54] VEHICLE LAMP VENTILATION SYSTEM

[75] Inventor: Sylvan R. Ketterman, Pendleton, Ind.

[73] Assignee: General Motors Corporation, Detroit, Mich.

[21] Appl. No.: 573,620

[22] Filed: Aug. 28, 1990

[51] Int. Cl.[5] ..... F21M 3/00

[52] U.S. Cl. ..... 362/61; 362/294; 362/345

[58] Field of Search ..... 362/61, 294, 345, 376

[56] References Cited

U.S. PATENT DOCUMENTS 4,635,173 1/1987 Dressler et al. ..... 362/294
4,833,572 5/1989 Nagengast et al. ..... 362/294
4,862,337 8/1989 Ohshio et al. ..... 362/294
4,931,912 6/1990 Kawakami et al. ..... 362/294
4,937,710 6/1990 Hurley et al. ..... 362/294

*Primary Examiner*—Ira S. Lazarus
*Assistant Examiner*—Richard R. Cole
*Attorney, Agent, or Firm*—Edward J. Biskup

[57] ABSTRACT

A ventilation system for a replaceable bulb vehicle lamp assembly that has a vent device mounted on a tubular projection formed on the outer surface of the reflector housing and having an air outlet opening positioned closely adjacent a channel formed in the outer surface of said reflector in a manner so as to prevent splash water from entering the interior of the lamp assembly.

3 Claims, 1 Drawing Sheet

VEHICLE LAMP VENTILATION SYSTEM

This invention concerns vehicle lamp assemblies of the replaceable bulb type and more particularly relates to a vent device which is part of a ventilation system for such lamp assemblies.

In order to prevent moisture from accumulating into the interior of a non-hermetically sealed vehicle taillamp or headlamp, it is desirable to have some form of vent device connected to the lamp housing so as to provide a ventilation system that maintains an airflow through the interior of the lamp. In additional, the ventilation system should be designed so that water which might to splashed upwardly towards the vent device during the travel of the vehicle or while the vehicle is in a carwash facility does not enter the interior of the headlamp.

To this end, the present invention is directed to a ventilation system for a vehicle lamp that includes a vent device which meets the above objectives. More specifically, the ventilation system according to the present invention includes a vent device that is combined with a vehicle lamp housing provided with a backwall defined by an inner reflecting surface and an outer support surface. A tubular projection extends outwardly from the support surface of the lamp housing and has an opening formed therein for allowing ventilating air to flow into and out of the lamp housing. The vent device has a body portion provided with a vertically orientated front face that is generally rectangular in configuration and is formed with an air inlet opening and an air outlet opening located in vertical alignment with each other. A C-shaped passage formed in the body portion of the vent device interconnects the air inlet opening with the air outlet opening. In the preferred form of the present ventilation system, a T-shaped channel is formed in the outer support surface of the vent device adjacent to the tubular projection and the air inlet opening portion is secured to the tubular projection with the air outlet opening being positioned so as to cover a part of the channel and thereby prevent splash water from entering the interior of the lamp while allowing air to flow via the exposed portions of the channel into and out of the lamp housing.

The objects of the invention are to provide a new and improved ventilation system for a vehicle lamp that allows ventilating air to flow into and out of the interior of the lamp while preventing splash water from entering the interior of the lamp; to provide a new and improved ventilation system for a vehicle lamp that includes a vent device having a body portion that is generally rectangular in configuration and provided with a front face formed with a vertically spaced air inlet opening and air outlet opening and wherein the latter engages a grooved part of the lamp housing so as to provide a covered conduit for allowing air to flow into and out of the interior of the lamp; to provide a new and improved ventilation system for a vehicle lamp that includes a vent device which can be mounted on a tubular projection formed on the outer surface of the reflector housing and having an air outlet opening that is positioned closely adjacent to a channel formed in the outer surface so as to prevent splash water from entering the interior of the housing while at the same time allowing ventilating air to enter and exit the housing; and to provide a new and improved ventilation system for a reflector housing vent device having a body portion formed with C-shaped passage that connects with an air inlet opening and and air outlet opening both of which are located adjacent each other along a vertical axis and in a common vertically orientated plane and wherein the outlet opening directly communicates with a T-shaped channel formed in the reflector housing for allowing air to flow into and out of the housing.

The following patents show ventilation systems for lamps that in some respects are similar to the ventilation system according to the present invention:

| Patent No. | Inventor | Issue Date |
|---|---|---|
| 4,862,337 | Ohshio et al | Aug. 29, 1989 |
| 4,809,144 | Suzuki | Feb. 28, 1989 |
| 4,747,032 | Weber | May 24, 1988 |
| 4,635,173 | Dressler et al | Jan. 06, 1987 |

Also, Stanley Electric of Japan uses a vent device that structurally is similar to the vent device incorporated with the present ventilation system except that a channel is not provided in the reflector housing and instead a separate shield is integrally formed with the reflector housing below the vent device.

Other objects and advantages of the present invention will be apparent from the following detailed description when taken with the drawing in which.

Figure 1:
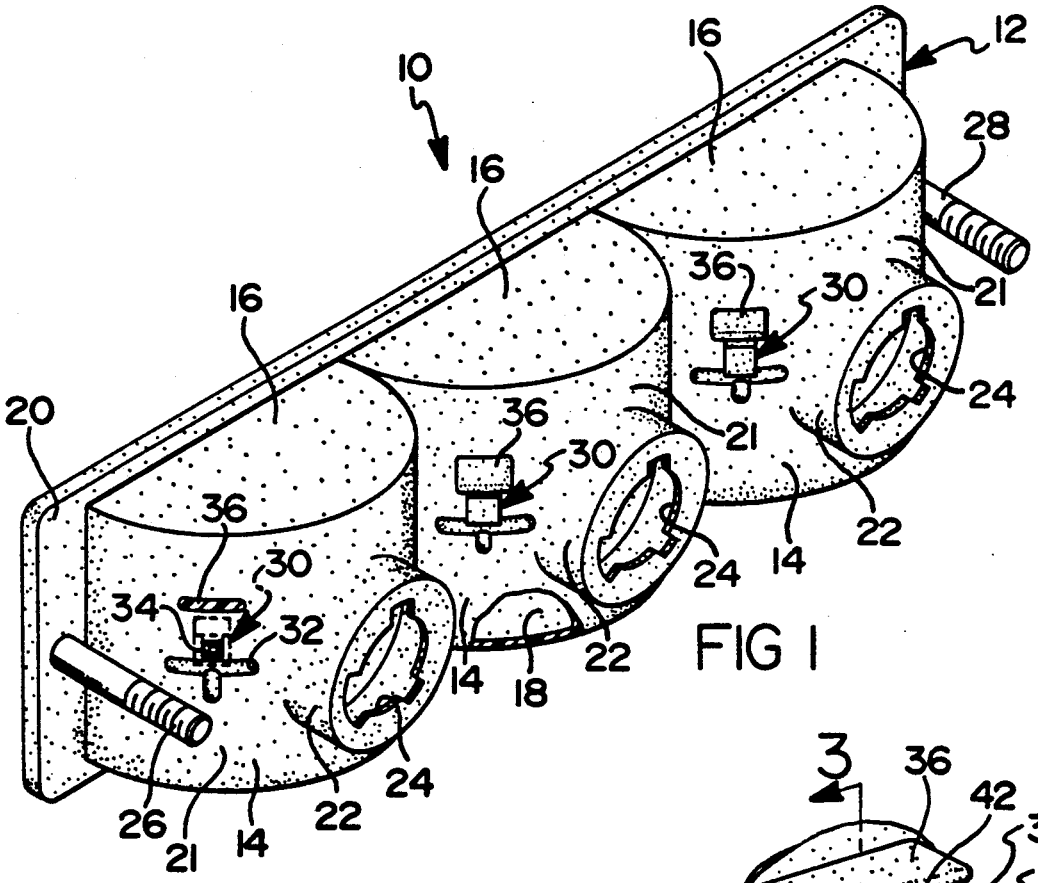
FIG. 1 is a perspective view of a vehicle lamp housing incorporating a ventilation system made in accordance with the present invention.

Referring now to the drawing and more particularly FIG. 1 thereof the rear of a vehicle taillamp assembly 10 is shown incorporating a ventilation system made in accordance with the present invention. The taillamp assembly includes the usual reflector housing 12 which, in this case, consists of three cavities each of which is defined by a backwall 14, a top wall 16, and a bottom wall 18. A rectangular flange 20 surrounds the cavities and, although not shown, supports a lens which closes the front of the housing 12 and has optics formed thereon for directing light rearwardly of the vehicle. In addition, each backwall 14 of the housing is defined by an inner parabolic reflecting surface (not shown) and an outer support surface 21 the latter of which is formed with a cylindrical boss 22 provided with an access opening 24 for receiving and retaining a conventional lamp socket assembly such as seen in U.S. Pat. No. 4,804,343 issued on Feb. 14, 1989 and assigned to the assignee of this invention. A pair of threaded studs 26 and 28 extend rearwardly from the side portions of the flange 20 and serve to fasten the taillamp assembly 10 to the sheet metal at the rear of the vehicle.

Figure 3:
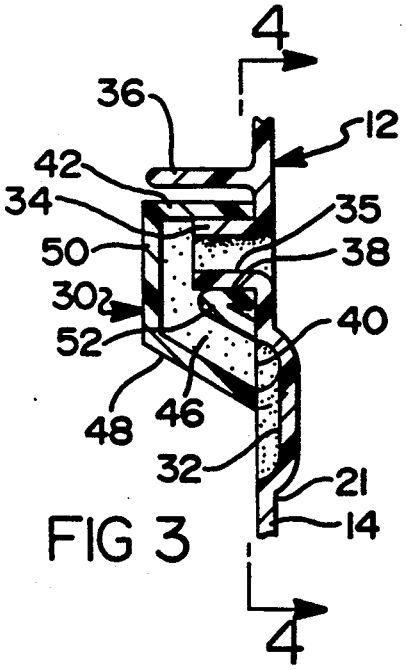
FIG. 3 is a sectional view of the vent device seen in FIG. 2 taken on line 3—3 thereof.

The ventilation system for the taillamp assembly 10 includes a vent device 30 secured to each backwall 14 of the housing 12 above a T-shaped channel 32 formed in the outer support surface 21 of the backwall 14. In this regard and as best seen in FIGS. 1 and 3, the backwall 14 of each cavity has a tubular projection 34 integrally formed therewith that is square in cross section and provide with a centrally located hole 35 that serves to allow air to flow into and out of the interior of the taillamp assembly 10. The vent device 30 associated with each cavity of the housing is identical in structure and is mounted on the tubular projection 34 below a protector rib 36 integrally formed with the backwall 14 and cooperates with the T-shaped channel 32 to allow ventilating air to flow into and out of the interior of the taillamp assembly 10 while preventing splash water from gaining access to the interior of the housing 12.

Figure 2:
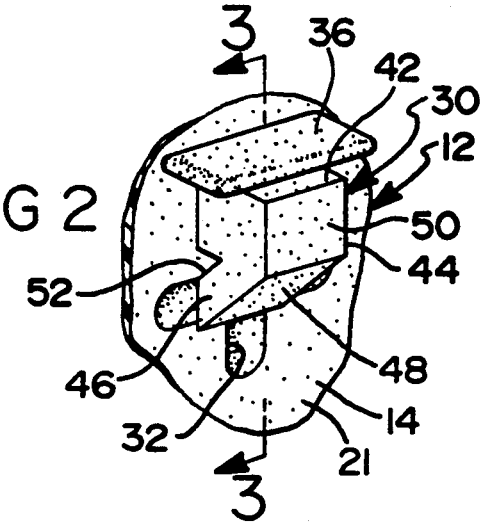
FIG. 2 is an enlarged perspective view of one of the vent devices incorporated in the ventilation system seen in FIG. 1.
Figure 4:
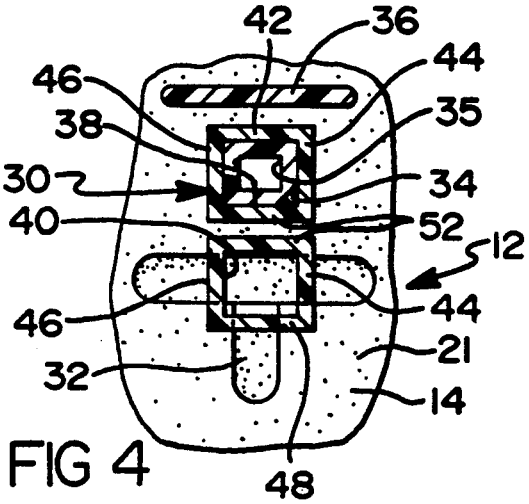
FIG. 4 is a sectional view of the vent device seen in FIG. 3 taken on line 4—4 thereof.

As best seen in FIGS. 2–4, the vent device 30 is made from an elastomeric material and includes a body portion formed with a C-shaped passage that connects with an air inlet opening 38 and an air outlet opening 40. The air inlet opening 38 and the air outlet 40 opening are located in the front face of the body portion in vertical alignment. The C-shaped passage in the body poriton of the vent device is defined by a horizontal top wall 42, a pair of laterally spaced vertical side walls 44 and 46, an inclined bottom wall 48, a vertical backwall 50, and a cross wall 52. As seen in FIGS. 3 and 4, the air inlet opening 38 is defined by the top wall 42, side walls 44 and 46, and the cross wall 52. The air outlet opening 40 is also defined by the cross wall 52, the side walls 44 and 46, and the inclined wall 48.

FIGS. 2 and 3 show the vent device secured to the tubular projection 34 in the operative position. As shown the air inlet opening 38 of the vent device 30 sealingly and frictionally mates with the tubular projection 34 and has the air outlet opening end of the vent device 30 contacting the outer support surface 21 of the backwall 14 immediately above and below the cross arm portion of the T-shaped channel 32. Thus, the air outlet opening 40 of the vent device 30 partially covers the T-shaped channel 32 allowing the ends of the cross arm portion and the lower end of the upstanding arm portion of the T-shaped channel 32 to be exposed. Accordingly, air can flow into and out of the interior of the taillamp assembly 10 via the hole 35 in the tubular projection 34, the C-shaped passage in the vent device 30, and the opposed ends of the cross arm portion and lower end of the upstanding are portion of the T-shaped channel 32. At the same time, the inclined wall 48 together with the side walls 44 and 46 backwall 48 serve as a shield to prevent splash water from gaining access to the hole 35 in the tubular projection 34 and flowing into the interior of the taillamp assembly 10.

It will be understood that although each vent device 30 shown in FIG. 1 is located on the same side of the associated cavity of the taillamp assembly 10, the positioning of the vent device 30 on the associated backwall 14 can vary depending on the design of the taillamp assembly 10 and the amount of air flow between cavities that is desired. In other words, it may be that adequate ventilation of a lamp assembly can be achieved by having the vent device 30 located at the outer cavities only and not in the center cavity as seen in FIG. 1. Also, the vent devices 30 may provide acceptable ventilation if located at a high point of one cavity and a low point of another cavity rather than in horizontal alignment as seen in FIG. 1. It should be apparent, therefore, that the location of the vent devices 30 as seen in FIG. 1 is for illustrative purposes only and can vary as explained above.

Various changes and modifications can be made in the above described ventilation system without departing from the spirit of the invention. Such changes and modifications are contemplated by the inventor, and he does not wish to be limited except by the scope of the appended claims.

The embodiments of the invention in which an exclusive property or privilege is claimed are defined as follows:

1. In combination with a vehicle lamp housing provided with a backwall defined by an inner reflecting surface and a outer support surface, a tubular projection extending outwardly from said support surface of said lamp housing and having an opening formed therein for allowing air to flow into and out of said lamp housing, a channel formed in said outer support surface of said housing adjacent said tubular projection, a vent device made of an elastomeric material connected to said tubular projection and cooperating with said channel to provide a shielded passage for said air to flow to and from said opening through said channel for venting the interior of said lamp housing.

2. In combination with a vehicle lamp housing provided with a backwall defined by an inner reflecting surface and a outer support surface, a tubular projection extending outwardly from said support surface of said lamp housing for allowing air to flow into and out of said lamp housing, a channel formed in said outer support surface of said housing adjacent said tubular projection, a vent device made of an elastomeric material connected to said tubular projection, said vent device having a body portion provided with a front face that is generally rectangular in configuration and formed with an air inlet opening and an air outlet opening, said body portion having a C-shaped passage formed therein for interconnecting said air outlet opening and air inlet opening, said air inlet opening being connected to said tubular projection in a manner so that said air outlet opening is in contact with the outer support surface above and below said channel so as to prevent splash water from entering the interior of said lamp housing via said C-shaped passage of said vent device while allowing air to flow into and out of the interior of said lamp via said channel.

3. In combination with a vehicle lamp housing provided with a backwall defined by an inner reflecting surface and a outer support surface, a tubular projection extending outwardly from said support surface of said lamp housing for allowing air to flow into and out of said lamp housing, a T-shaped channel formed in said outer support surface of said housing adjacent said tubular projection, a vent device made of an elastomeric material connected to said tubular projection, said vent device having a body portion provided with a front face that is generally rectangular in configuration and formed with an air inlet opening and an air outlet opening located in vertical alignment with each other, said body portion having a C-shaped passage formed therein for interconnecting said air outlet opening and air inlet opening, said air inlet opening being connected to said tubular projection in a manner so that said air outlet opening is in contact with the outer support surface above and below the cross arm portion of said T-shaped channel so as to prevent splash water from entering the interior of said lamp housing via said C-shaped passage of said vent device while allowing air to flow into and out of the interior of said lamp via said channel.

* * * * *